US009925558B2

(12) United States Patent
Belanger

(10) Patent No.: US 9,925,558 B2
(45) Date of Patent: Mar. 27, 2018

(54) PROCESS FOR APPLYING ADHESIVE TO INTERIOR WALL OF A HOLE UTILIZING A NOZZLE

(71) Applicant: Adhesive Technologies, Inc., Hampton, NH (US)

(72) Inventor: Richard A. Belanger, Kensington, NH (US)

(73) Assignee: ADHESIVE TECHNOLOGIES, INC., Hampton, NH (US)

( * ) Notice: Subject to any disclaimer, the term of this patent is extended or adjusted under 35 U.S.C. 154(b) by 0 days.

(21) Appl. No.: 14/958,045

(22) Filed: Dec. 3, 2015

(65) Prior Publication Data

US 2016/0158797 A1 Jun. 9, 2016

Related U.S. Application Data

(62) Division of application No. 13/292,273, filed on Nov. 9, 2011, now abandoned.

(Continued)

(51) Int. Cl.

| | |
|---|---|
| ***B05D 1/26*** | (2006.01) |
| ***B05C 17/005*** | (2006.01) |
| ***B65D 83/00*** | (2006.01) |
| ***B05D 7/22*** | (2006.01) |
| ***B05D 7/06*** | (2006.01) |

(Continued)

(52) U.S. Cl.

CPC ..... *B05D 1/26* (2013.01); *B05C 17/00503* (2013.01); *B05C 17/00516* (2013.01); *B05D 7/06* (2013.01); *B05D 7/22* (2013.01); *B27G 11/00* (2013.01); *B43M 11/06* (2013.01); *B65D 83/00* (2013.01); *B05D 2259/00* (2013.01)

(58) Field of Classification Search

CPC .. B27G 11/00; B05C 17/00516; B43M 11/06; B65D 83/00; B05D 1/26; B05D 7/06; B05D 7/22; B05D 2259/00

USPC ..... 239/302, 548, 556, 557; 118/300, 317; 222/630, 631, 632, 493, 566, 567, 568; 427/230–239

See application file for complete search history.

(56) References Cited

U.S. PATENT DOCUMENTS 1,936,906 A * 11/1933 Green ..... B27G 11/005 222/321.6

2,694,211 A 11/1954 Warren (Continued)

FOREIGN PATENT DOCUMENTS

GB 2 058 726 A * 4/1981

GB 2 285 430 7/1995

*Primary Examiner* — William P Fletcher, III

(74) *Attorney, Agent, or Firm* — Clark & Brody

(57) ABSTRACT

A nozzle for applying a fluid material to an object includes a tubular wall with several circumferentially spaced ribs that extend outward from the tubular wall to engage an object to which the fluid material is to be applied. The ribs space the tubular wall from the inner wall to provide a gap for the fluid material and aligning the tubular wall with the hole in the object. The tubular wall provides at least one opening between adjacent pairs of ribs for the fluid material to flow into the gap. A sealing surface on the nozzle engages a portion of the object preventing escape of the fluid from the gap. In a process for using the nozzle, a user manually detects equilibrium between the pressure applied to the fluid in the nozzle and the pressure in the nozzle to determine when the gap has been filled.

2 Claims, 4 Drawing Sheets

Related U.S. Application Data

(60) Provisional application No. 61/411,805, filed on Nov. 9, 2010.

(51) Int. Cl.
*B43M 11/06* (2006.01)
*B27G 11/00* (2006.01)

(56) References Cited

U.S. PATENT DOCUMENTS

| | | | | |
|---|---|---|---|---|
| 2,877,480 | A | 3/1959 | Warren | |
| 4,080,078 | A | 3/1978 | Halm | |
| 4,180,601 | A | 12/1979 | Kopis | |
| 4,509,884 | A * | 4/1985 | Trout | E04G 23/0203 141/293 |
| 5,010,841 | A | 4/1991 | Stewart | |
| 5,145,301 | A * | 9/1992 | Yamamoto | F16B 13/141 411/508 |
| 5,180,021 | A * | 1/1993 | Champion | E21B 7/06 175/325.2 |
| 5,516,224 | A | 5/1996 | Moshammer | |
| 7,168,877 | B2 | 1/2007 | Park | |
| 8,905,264 | B2 | 12/2014 | White | |
| 2007/0127978 | A1 | 6/2007 | Park | |
| 2007/0235121 | A1* | 10/2007 | Smelik | B05C 5/0204 156/81 |
| 2008/0307627 | A1 | 12/2008 | Gertner | |
| 2011/0198372 | A1* | 8/2011 | White | B05C 7/00 222/482 |

* cited by examiner

PROCESS FOR APPLYING ADHESIVE TO INTERIOR WALL OF A HOLE UTILIZING A NOZZLE

CROSS-REFERENCE TO RELATED APPLICATION

This application claims the benefit under 35 USC § 119(e) of U.S. Provisional application Ser. No. 61/411,805, which was filed Nov. 9, 2010, the disclosure of which is hereby incorporated by reference.

TECHNICAL FIELD

This invention relates to the application of coatings such as adhesives. In particular, the invention relates to a nozzle for applying a liquid adhesive to the interior of a hole for securing a plug in the hole.

BACKGROUND ART

It is known to attach one material to another with a fastener such that the head of the fastener lies just below the upper surface of the one material. For example, it is known to countersink the head of a screw fastener below the surface of a sheet of material being secured to another. It is also known to fill the space between the countersunk screw head and the surface of the material with a dowel having an upper surface flush with the upper surface of the material.

It is also known to provide a drill bit capable of drilling both a hole for a screw and a countersink hole for recessing the head of the screw. United States Patent Application Publication 2008/0307627 (Gertner) describes a system utilizing such a drill and also using plugs for filling the countersink holes. The plug is typically of the same material as the material being secured and is preferably secured in the countersink hole by an adhesive.

To make a suitable bond between the plug and the hole, typically, the plug is rolled over a puddle of the glue or otherwise coated until the cylindrical surface is fully coated. Then, the plug is inserted into the hole and driven flush or near flush with a hammer. The types of glue used vary, but typically PVA glue, epoxy, urethanes and other types of "carpenter's glue" are used in this application. The most suitable glue for the application may be determined by repetitive testing involving ASTM as well as other customized methods including environmental exposure conditions.

In using the known methods, there is a considerable collection of extra glue as the glue-coated plug is driven into the hole, which can make a mess on the face of the hammer as well as stain the wood in the vicinity of the glue joint unnecessarily. Each joint on the surface of the wood needs to be cleaned thoroughly and, of course, the hammer cleaned as well. The process is inherently time consuming and cumbersome.

SUMMARY OF THE INVENTION

A nozzle has been developed that is capable of applying a light, uniform coating of adhesive, sealant or other material to the inside cylindrical surface of a drilled hole in wood or other material that is to be fastened, as by a screw, to a frame member and then plugged with a plug for aesthetic effect. Specifically, a screw hole in an outdoor decking wood, which is approximately 0.335" diameter×0.300" deep, is to be plugged with a wooden plug slightly tapered, slightly larger, and slightly shorter than the hole itself.

It is a specific intention of this invention to "clean up and speed up" the application of the glue to this joint to minimize the staining of the wood and the investment in clean up time as well as provide repeatability and consistency in the amount of glue applied.

Objects of this invention are to provide a unique nozzle that:

- Can mate with an existing 1.5 fl. oz. tube of adhesive or caulk particularly that described in United States Published Patent Application 2007/0119865, which was filed on Feb. 7, 2005 and entitled Cartridge Dispenser for Liquid or Semi-Liquid Materials, the entire disclosure of which is incorporated by reference herein.
- Can handle a wide variety of glues and adhesives.
- Eliminates mess associated with the application.
- Allows the tube to be resealed and reused.
- Is inexpensive and easily manufactured in significant quantities.
- Is universally adaptable in design to similar applications.

DETAILED DESCRIPTION OF THE INVENTION

Figure 1:
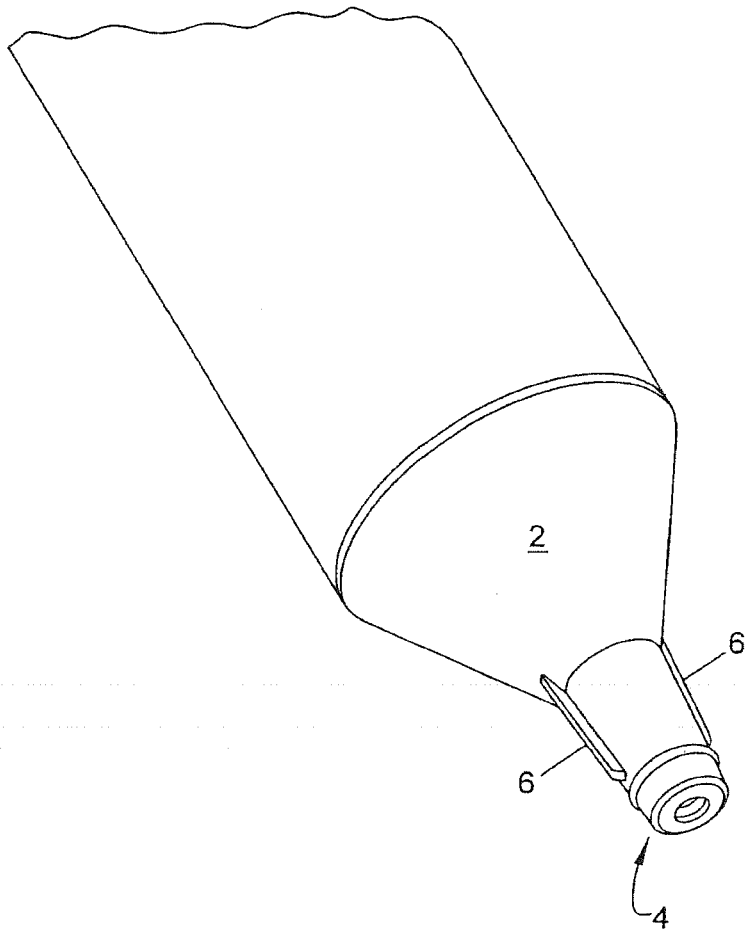
FIG. 1 PRIOR ART
FIG. 1 is a perspective of a prior art adhesive cartridge.

FIG. 1 illustrates a tube 2 such as is shown in the aforementioned published patent application. The tube is filled with an appropriate adhesive and shipped and stored with a snap-on translucent polyethylene cover (not shown) which provides air and liquid tight seals. The nozzle end of tube 2 includes an annular seal ring 4 molded into the tip of the tube to create an interference with any caps, covers and seals attached to it for a snap fit and pressure seal. Two radial mounting struts 6 are molded into the end of the tube. These struts are optional for providing angular alignment of nozzles intended to be "non-rotating" by design, such as nozzles that create a ribbon pattern.

Figure 2:
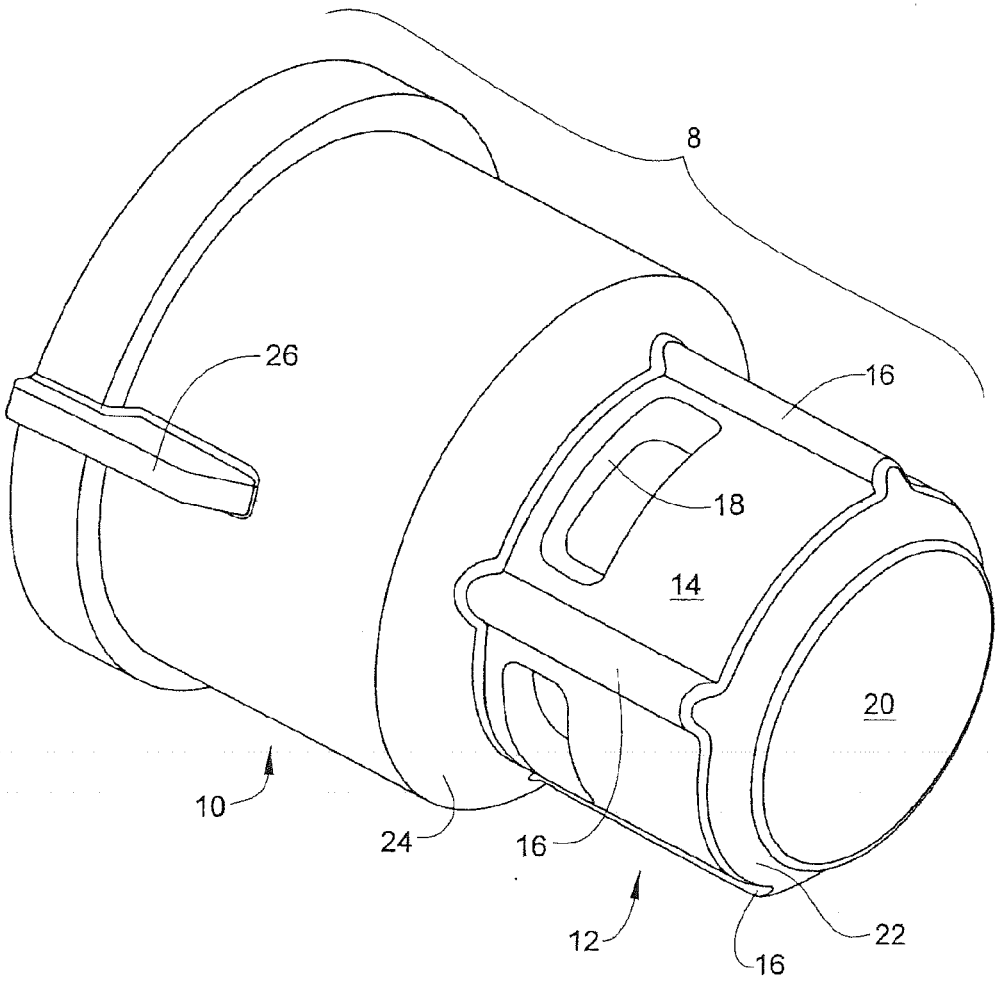
FIG. 2 is a perspective of an embodiment of a nozzle in accordance with the invention.

FIG. 2 illustrates a nozzle 8 in accordance with the invention. The nozzle includes a base 10 that is configured and sized to fit onto the annular seal ring 4 on the tube 2. The base may be configured to fit on any of a wide variety of tubes for being in fluid communication with the contents of the tube. The nozzle also includes an applicator tip 12, which is in fluid communication with the base 10 and, as well, with the tube 2. The applicator tip 12 includes a wall portion 14 that is shown to be cylindrical, but can be of other shapes depending on the shape of the countersink hole into which it will be inserted. Extending outward from the outer surface of the wall portion 14 are several ribs 16. The ribs 16 are spaced along the circumference of the wall portion 14 to ensure accurate alignment of the nozzle in a countersink hole. That is, the objective is to align the applicator tip 12 in the hole such that the wall portion is evenly spaced from the interior of the countersink hole. When the hole is cylindrical, the wall 14 is preferably cylindrical also and the cylindrical axes of the two coincide for alignment. The ribs preferably extend along the major part of the applicator tip 12 to facilitate alignment and to prevent entry of the applicator tip at an angle, which would result in misalignment. The ribs may, however, extend only over a smaller part of the length of the wall 14 because the sealing surface also assists in alignment. The outer surfaces of the ribs are positioned collectively such that they fit securely in a hole of known dimension to allow the applicator tip 12 to be inserted easily but without play that would result in misalignment of the applicator tip. The depth of the ribs, the distance between the wall 14 and the outer surface of the rib, is selected to allow flow of an adhesive along the wall of the countersink hole.

Several openings 18 are formed in the wall 14, each opening being located between a pair of ribs 16. The openings shown in FIG. 2 are rectangular in side view with rounded corners. In a preferred embodiment, the applicator tip has four evenly spaced ribs and four evenly spaced openings 18.

The bottom portion 20 of the applicator tip may be flat and connected to the wall 14 by a bevel 22. The bevel may be conical or spherical, or of other shapes.

Nozzle 8 also provides a sealing surface 24 between the base 10 and the applicator tip 12. The sealing surface is designed to engage a surface of the material being secured as will be described below.

Base portion 10 may have one or more alignment slots 26 to engage radial mounting struts 6 to align the nozzle on the tube 2, or to prevent twisting of the nozzle and thereby maintain alignment.

Figure 3:
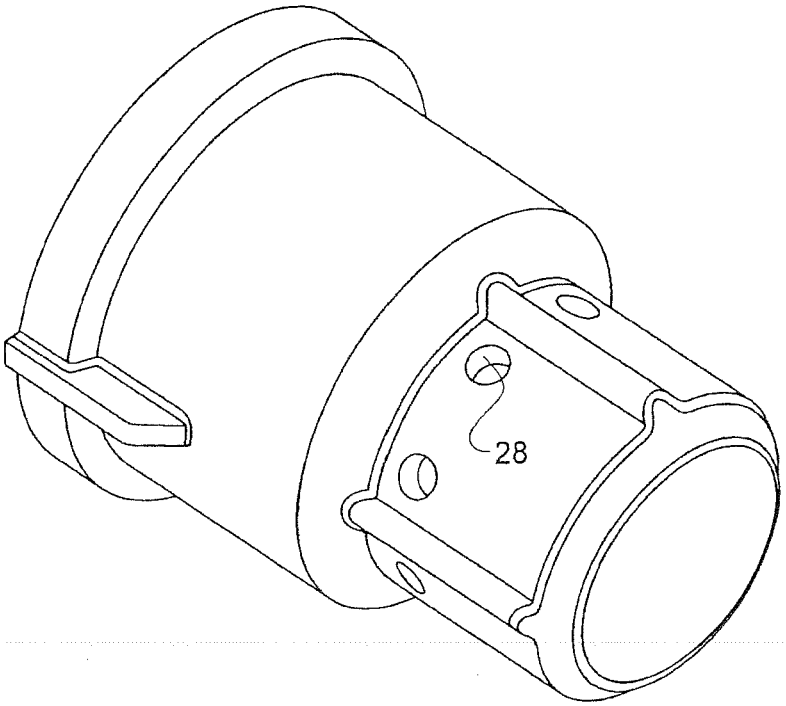
FIG. 3 is a perspective of a second embodiment of a nozzle in accordance with the invention.

FIG. 3 shows another embodiment of a nozzle, which is similar to that shown in FIG. 2 but has circular openings 28. FIG. 3 illustrates two openings between each pair of ribs spaced 45 degrees apart, but any number can be used.

The embodiments shown in FIGS. 2 and 3 provide essentially the same function. That is, they allow the pressurized glue to exit via the radial holes evenly. The particular embodiment employed is dependent upon the manufacturer's tooling limitations, flow characteristics desired, etc.

Figure 4:
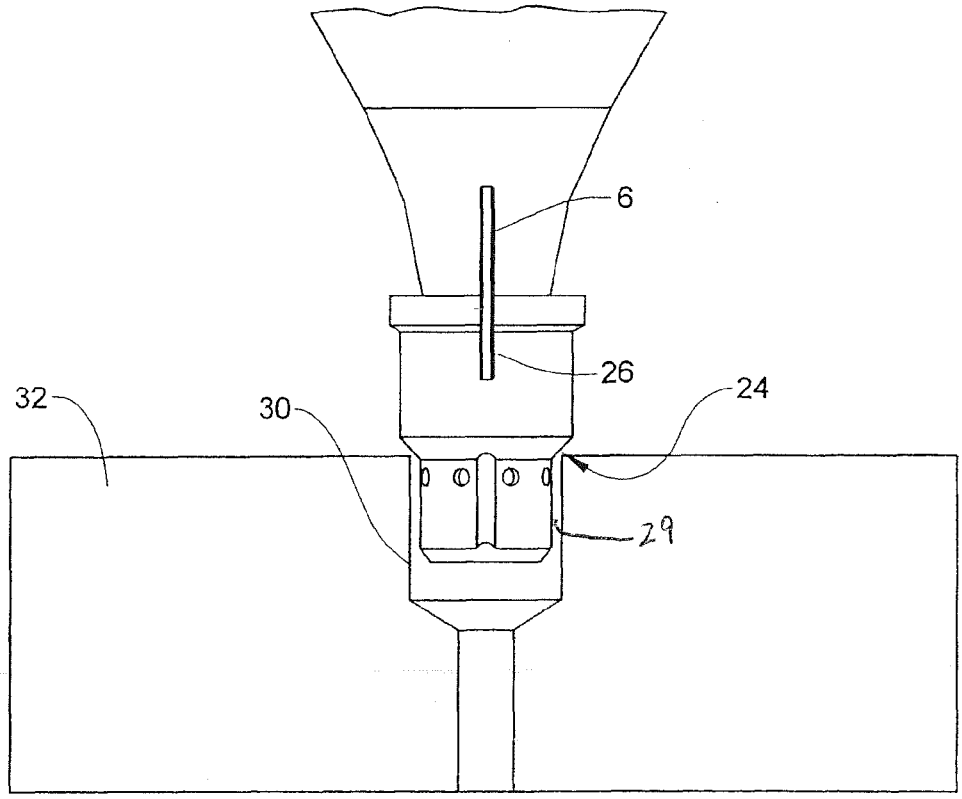
FIG. 4 is a side view of a cartridge as shown in FIG. 1 with the nozzle of FIG. 3 attached and inserted into a countersink hole.

FIG. 4 illustrates the nozzle of FIG. 3 attached to a tube 2 fully engaged in a countersink hole 30 in a board 32.

In preparation for gluing the holes, the filled tube 2 is attached to an applicator handle for easy manipulation of the tube. The user removes any snap-on seal cap from the end of the tube 2 and attaches the nozzle 8 by aligning the radial mounting struts 6 with the alignment slots 26. Then the user provides an axial force to slightly cause a stretch of the body of the nozzle as it slips past the annular sealing ring 4 on the tube 2 creating the "snap-fit" and pressure seal.

The user then inserts the loaded and ready tube with nozzle into the drilled hole, being careful to maintain as near as possible to a perpendicular orientation to the board to align with the hole 30. Once fully inserted, moderate force is exerted on the tube, which has the desired effect of mating the 90 degree included angled surface 24 with the cleanly cut top edge of the hole 30, thus creating a line-to-line dynamic pressure seal.

The four rounded ribs 16 on the outside surface of the rounded body of the nozzle, specifically sized to allow a predetermined gap 29 between the I.D. of the hole 30 and the O.D. of the applicator tip 12 provides a centering means to guarantee that the gap is consistent on all sides. They are sized to be a very close, but sliding fit with the ID of the hole. With the nozzle in place, being held down by moderate force continuously creates a "mold" for the glue, about to be pressurized, to flow around and into the hole 30.

Once the glue is pressurized by application of pressure to the tube 2, glue flows from the nozzle 4 of the tube, into the nozzle 8. Once filled, the nozzle 8 holds a pressure within the body of the nozzle causing the glue to flow under uniform pressure to all orifices equally and exit the nozzle in a radial direction.

When the glue is under pressure from the tube it will first fill the area proximate to the openings, and the pressure seal created by contact between the angled surface 24 and the upper edge of the hole 30 as well as the precise diameter gap provided by the ribs 16 allows equal filling of the gaps with glue. The back pressure causes the glue then to find the easiest path, which is down the nozzle body and between it and hole 30, uniformly coating the ID of the hole and the OD of the nozzle body. When used manually, the user senses when pressure equilibrium between the glue in the tube and the glue in the nozzle 8 is attained. Knowing that this pressure equilibrium creates the necessary flow of adhesive to fill, but not overfill the hole, the user then releases the pressure on the tube and retracts the nozzle from the hole. This could as well be automated by using an electronic or other type of pressure sensor.

A wooden plug is now placed on the top of the hole with the grain aligned to match the grain of the board and with its chamfered leading edge in axial alignment with the hole. It takes several moderate blows with a lightweight hammer to drive the plug until the top of the plug is flush with the top surface of the board. Then, any minor amount of residual glue that might have squeezed from the joint can be wiped with a damp rag at this time.

It will be appreciated that the disclosed multi-faceted nozzle, which provides a snap-on fit with the tube, a pressure seal with the tube, centering ribs and any number of radial holes, could be utilized in a number of applications other than gluing deck plugs. Clearly, with only minor modifications and dimensional matching, this nozzle could be used to apply lubricants, thread-lockers and many other liquids and paste consistency materials to a variety of substrates. The scope of the invention is not limited to a particular size, shape, or specific task.

The disclosed nozzle can be molded as an integral part of the caulking tube referenced, or any caulking tube of any size. It is envisioned that a very similar shape as embodied, molded into the tip of a caulking tube, with or without a means for providing a snap on or interference fit outer seal, could actually be an improvement of this design. In other words, the functional part of this nozzle need not be removable if a seal cap, capable of making a hermetic seal, can cover the outside of tip of a tube with the centering nozzle molded integrally. But, it could also be intentionally designed as a throwaway nozzle and/or tube since it is inexpensive to manufacture, typically.

It is a further realization of the invention that this nozzle could be coupled with a tool that delivers a "metered shot" of liquid or paste either by limiting the stroke of the triggering of the tool or by pressure limitation or some other means.

It is a yet a further realization of the invention that this type of nozzle could incorporate either internal or external threading to allow attachment to other types of either hand-held or automated equipment.

Another embodiment is where the nozzle could be made from materials other than semi-rigid plastics such as PE. It would work as well with smoothly machined rigid metals, for example.

A still further embodiment is where the nozzle could be made of more than one piece and such that it can be disassembled so that a family of diameters could be mated to the center piece of the assembly to provide the user with flexibility on the hole size.

Another embodiment would allow the outside shape of the nozzle to have a slight taper which would conceivably allow for easier withdrawal from the hole without affecting the integrity of the glue applied. This could be important with viscous materials or where better precision is necessary.

It is also envisioned that a very similar nozzle could be designed where the same sealing and centering means are used, but the nozzle is designed with a tubular cross-section and the glue exits the center of the nozzle, radially inward. This approach could be used to coat dowels externally or apply thread locker to the outside threads of bolts, for example.

Modifications within the scope of the appended claims will be apparent to those of skill in the art.

I claim:

1. A method for applying a film of liquid adhesive to the interior wall of a cylindrical hole in an object, said cylindrical hole extending along a cylindrical hole cylindrical axis, comprising providing a tube of said liquid adhesive with a nozzle attached to an outlet thereof, inserting said nozzle into said cylindrical hole, creating a dynamic pressure seal between said object and said nozzle, causing said adhesive to flow into said nozzle by manually applying pressure to said tube of liquid adhesive while maintaining said dynamic pressure seal, manually sensing equilibrium between the pressure of the adhesive in the tube and the pressure of the adhesive in the cylindrical hole during said step of manually applying pressure, and after sensing said equilibrium, terminating said step of manually applying pressure, wherein said nozzle comprises a body having a first portion for engaging said tube of liquid adhesive and a second portion extending from said first portion and in fluid communication therewith, said second portion comprising a cylindrical wall portion having a wall portion cylindrical axis and a plurality of circumferentially spaced ribs extending radially from said cylindrical wall portion and extending along the major part of the second portion parallel to said cylindrical wall portion cylindrical axis for engaging said interior wall of said cylindrical hole to which said fluid material is to be applied, spacing said cylindrical wall portion from said interior wall of said cylindrical hole to provide a gap between said cylindrical wall portion and said interior wall for receiving said liquid adhesive, and aligning said cylindrical wall portion with said interior wall such that said cylindrical hole cylindrical axis coincides with said cylindrical wall portion cylindrical axis, at least one opening in said cylindrical wall portion located circumferentially between each respective pair of adjacent ribs to allow said liquid adhesive to flow into said gap, and an angled surface at a fixed distance from the bottom of said second portion configured to engage a portion of said object forming a top of said cylindrical hole when said spaced ribs are engaging said interior wall to prevent escape of said fluid from said gap by said dynamic pressure seal, said angled surface being immovable with respect to said bottom of said second portion.

2. A method according to claim 1 wherein said cylindrical wall portion is closed at an end distal from said first portion.

* * * * *